US007220156B2

(12) United States Patent
Yazaki et al.

(10) Patent No.: US 7,220,156 B2
(45) Date of Patent: May 22, 2007

(54) OUTBOARD MOTOR STEERING CONTROL SYSTEM

(75) Inventors: Makoto Yazaki, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 1 day.

(21) Appl. No.: 11/286,827

(22) Filed: Nov. 23, 2005

(65) Prior Publication Data

US 2006/0110990 A1 May 25, 2006

(30) Foreign Application Priority Data

Nov. 25, 2004 (JP) ..... 2004-340071

(51) Int. Cl.
*B63H 5/125* (2006.01)

(52) U.S. Cl. ..... 440/53; 114/144 RE; 440/58

(58) Field of Classification Search ..... 440/53, 440/58, 59, 60; 114/144 RE
See application file for complete search history.

(56) References Cited

U.S. PATENT DOCUMENTS 6,148,949 A * 11/2000 Kobayashi et al. ..... 180/446
6,755,276 B2 * 6/2004 Clephas ..... 180/402
6,843,195 B2 * 1/2005 Watabe et al. ..... 114/144 E

FOREIGN PATENT DOCUMENTS

JP 2002-187597 7/2002

* cited by examiner

*Primary Examiner*—Sherman Basinger
(74) *Attorney, Agent, or Firm*—Carrier, Blackman & Associates, P.C.; Joseph P. Carrier; William D. Blackman

(57) ABSTRACT

In an outboard motor steering control system having an actuator steering the outboard motor, three rotation angle sensors each detecting a rotation angle of a steering wheel, three steering angle sensors each detecting a steering angle of the outboard motor, and a controller determining a drive current to be supplied to the actuator based on the detected rotation angle and steering angle and supplies the current to the actuator to control its operation, the steering angle is estimated based on the current and a detected engine speed, and the controller determines the current based on the detected rotation angle and the estimated steering angle, when all of the steering angle sensors are detected to have failed, thereby enabling steering of the outboard motor to be continued even when the steering angle sensors have all failed.

12 Claims, 7 Drawing Sheets

OUTBOARD MOTOR STEERING CONTROL SYSTEM

CROSS-REFERENCE TO RELATED APPLICATION

The present application claims priority under 35 USC 119 based on Japanese patent application No. 2004-340071, filed Nov. 25, 2004, the entire disclosure of which is incorporated herein by reference.

BACKGROUND OF THE INVENTION

1. Field of the Invention

This invention relates to an outboard motor steering control system.

2. Description of the Related Art

In recent years, outboard motor steering control systems have been developed that eliminate the need for mechanical connection between the steering wheel and the steering mechanism of the outboard motor, as taught, for example, by Japanese Laid-Open Patent Application No. 2002-187597, particularly paragraphs 0022, 0025 and 0027 and FIG. 1. The outboard motor steering system taught by the reference is equipped with an actuator for steering the outboard motor and a rotation angle sensor for detecting the rotation angle of the steering wheel. The system controls the steering angle of the outboard motor by regulating the drive current to be supplied to the actuator based on the detected rotation angle.

Higher accurate control of the outboard motor steering angle to a desired value (i.e., a desired steering angle matched to the detected rotation angle of the steering wheel) can be achieved, for example, by additional implementation of feedback control on the technique set out in the reference. One specific way of achieving such control is to provide a steering angle sensor for detecting the steering angle of the outboard motor in addition to the rotation angle sensor for detecting the rotation angle of the steering wheel and control operation of the actuator so as to eliminate the error between the detected and desired steering angle values. However, this has a problem in that steering becomes impossible when the steering angle sensor fails.

SUMMARY OF THE INVENTION

An object of this invention is therefore to overcome this disadvantage and to provide an outboard motor steering control system that enables steering of an outboard motor to be continued even when a steering angle sensor for detecting the steering angle of the outboard motor fails.

In order to achieve the object, this invention provides a system for controlling steering of an outboard motor adapted to be mounted on a stem of a boat and having an internal combustion engine powering a propeller, comprising: an actuator steering the outboard motor relative to the boat; a rotation angle sensor detecting a rotation angle of a steering wheel installed at the boat; a plurality of steering angle sensors each detecting a steering angle of the outboard motor relative to the boat; a controller determining a drive current to be supplied to the actuator based on the detected rotation angle and at least one of the detected steering angles and supplying the determined drive current to the actuator to control operation of the actuator; an engine speed sensor detecting a speed of the engine; a steering angle estimator estimating the steering angle of the outboard motor relative to the boat, based on the determined drive current and the detected engine speed; and a steering angle sensor failure detector detecting failure of the steering angle sensors; wherein the controller determines the drive current based on the detected rotation angle and the estimated steering angle, when all of the steering angle sensors are detected to have failed.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An embodiment of an outboard motor steering control system according to the present invention will now be explained with reference to the attached drawings.

Figure 1:
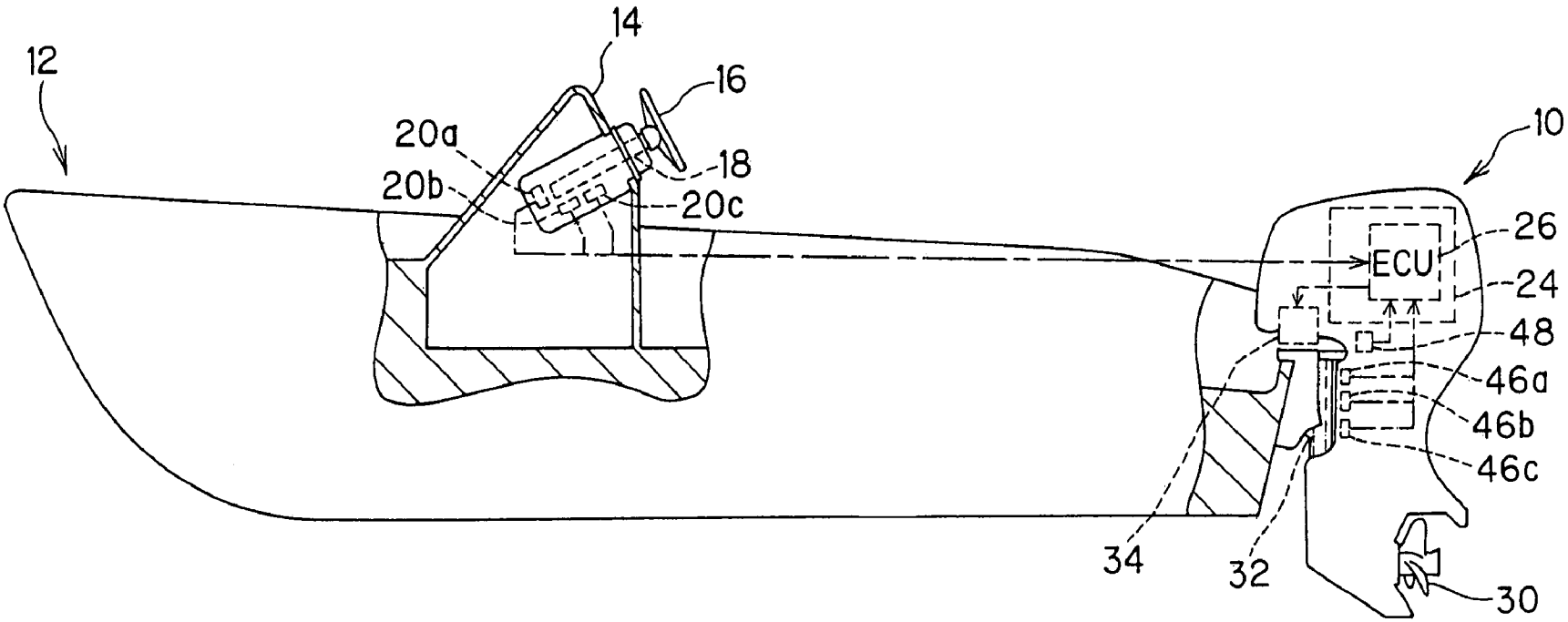
FIG. 1 is an overall schematic view of an outboard motor steering control system according to an embodiment of the invention.

FIG. 1 is an overall schematic view of an outboard motor steering control system according to an embodiment of the invention.

In FIG. 1, reference numeral 10 indicates an outboard motor. As illustrated, the outboard motor 10 is mounted on the stern (transom) of a boat (hull) 12.

A dashboard 14 of the boat 12 is installed with a steering wheel 16 that is freely rotated by the operator. A plurality of, specifically three rotation angle sensors 20*a*, 20*b* and 20*c* are installed near a rotary shaft (hereinafter referred to as "steering shaft") 18 of the steering wheel 16 and produce outputs or signals indicative of the rotation angle of the steering wheel 16. The rotation angle sensors indicated by 20*a*, 20*b* and 20*c* will be called the "first rotation angle sensor", "second rotation angle sensor" and "third rotation angle sensor", respectively.

The outboard motor 10 is equipped with an internal combustion engine 24 (hereinafter referred to as "engine") at its upper portion. The engine 24 comprises a spark-ignition gasoline engine. An electronic control unit (ECU) 26 that comprises a microcomputer is disposed near the engine 24. The outboard motor 10 is equipped at its lower portion with a propeller 30. The output of the engine 24 is transmitted to the propeller 30 such that the propeller 30 is rotated to generate thrust that propels the boat 12 in the forward and reverse directions. The outboard motor 10 is further equipped with an electric steering motor (actuator) 34 that is connected to a steering shaft (hereinafter referred to as "swivel shaft") 32.

Figure 2:
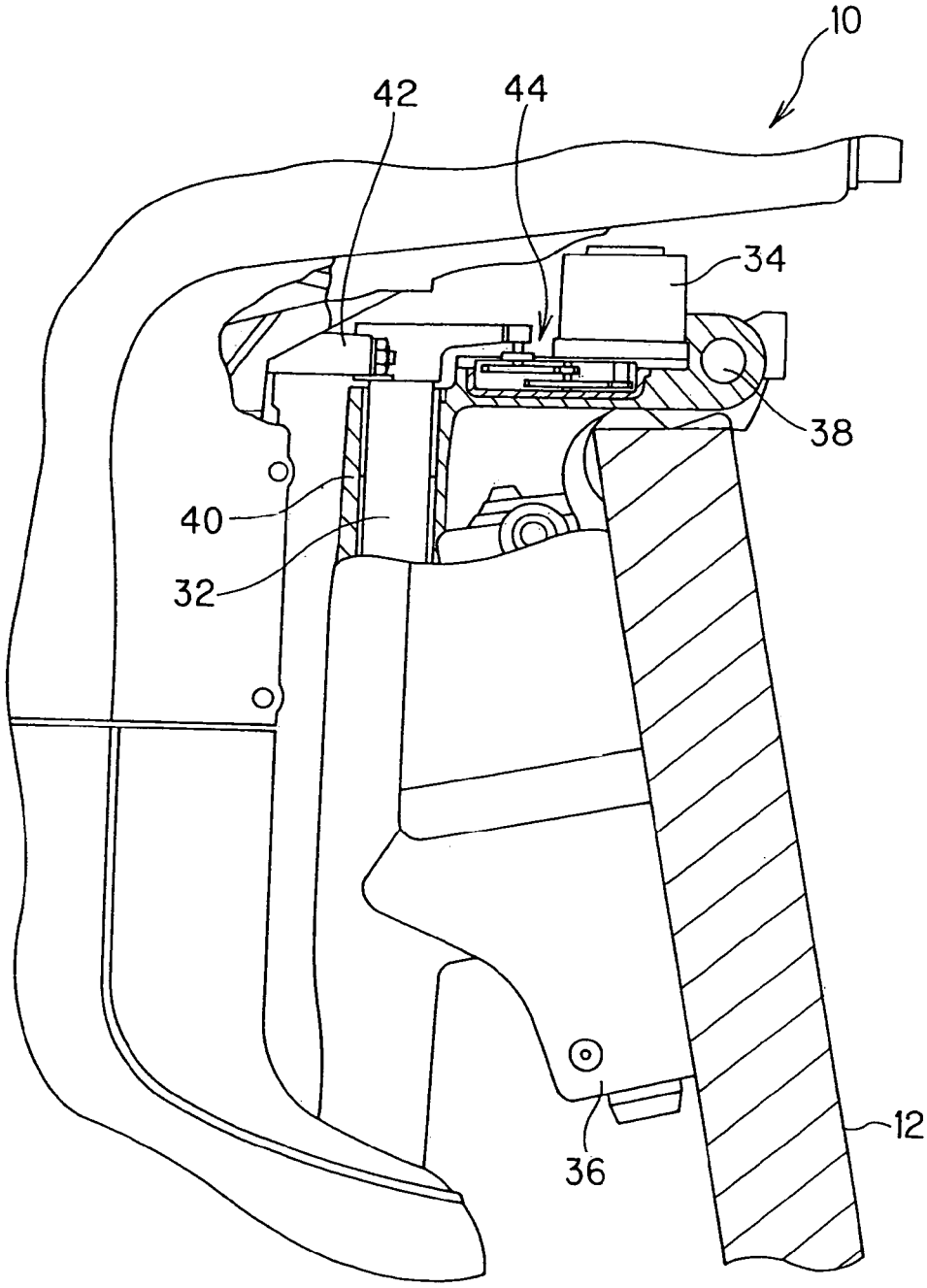
FIG. 2 is an enlarged partial sectional view of portions around a swivel shaft shown in FIG. 1.

FIG. 2 is an enlarged partial sectional view of portions around the swivel shaft 32 shown in FIG. 1.

As shown in FIG. 2, the outboard motor 10 is equipped with stern brackets 36 fastened to the stern of the boat 12. A swivel case 40 is attached to the stern brackets 36 through a tilting shaft 38. The swivel shaft 32 is housed in the swivel case 40 to be freely rotated about a vertical axis. The upper end of the swivel shaft 32 is fastened to a frame of the outboard motor 10 via a mount frame 42 and the lower end thereof is also fastened to the frame of the outboard motor 10 via a connecting member (not shown).

The upper portion of the swivel case 40 is installed with the steering motor 34. The output shaft of the steering motor 34 is connected to the mount frame 42 via a speed reduction gear mechanism 44. Specifically, a rotational output generated by driving the steering motor 34 is transmitted via the speed reduction gear mechanism 44 to the mount frame 42 such that the outboard motor 10 is steered about the swivel shaft 32 as a rotational axis to the right and left directions (i.e., steered about the vertical axis). The maximum steering angle of the outboard motor 10 is 30 degrees to the left and 30 degrees to the right.

The explanation of FIG. 1 will be resumed. A plurality of, specifically three steering angle sensors 46*a*, 46*b* and 46*c* are installed near the swivel shaft 32 and produce outputs or signals indicative of steering angle of the outboard motor 10. The steering angle sensors indicated by 46*a*, 46*b* and 46*c* will be called the "first steering angle sensor", "second steering angle sensor" and "third steering angle sensor", respectively. An engine speed sensor 48 is installed near a crank shaft (not shown) of the engine 24 and produces an output or a signal indicative of speed of the engine 24.

The dashboard 14 of the boat 12 is installed or provided with, in addition to the steering wheel 16, a lever, etc., that are to be manipulated by the operator to input instructions to change a shift (gear) position, to regulate the engine speed or the like. Although the outboard motor 10 is also equipped with an actuator that drives a shift mechanism in response to an instruction of shift change, another actuator that opens or closes a throttle valve of the engine 24 in response to an instruction of speed regulation and the other components, they are not directly related to this invention and thereby omitted in FIG. 1.

Figure 3:
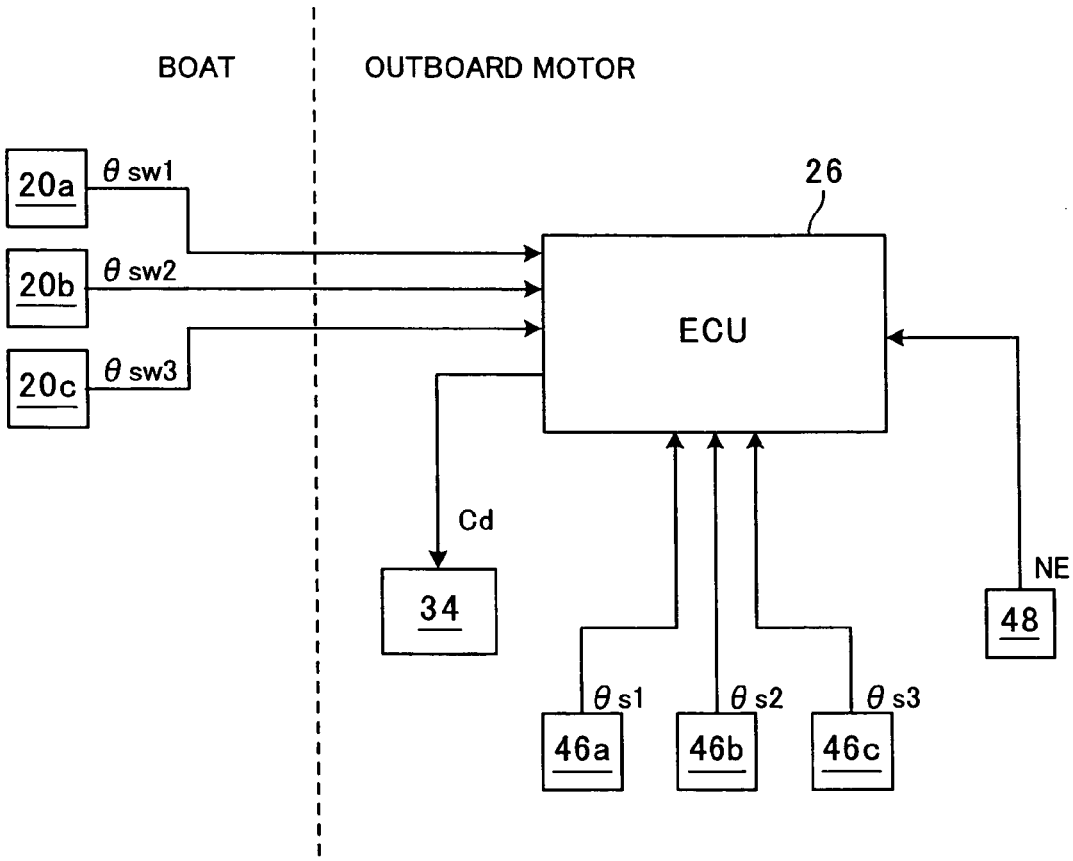
FIG. 3 is a block diagram showing the configuration of the outboard motor steering control system shown in FIG. 1.

FIG. 3 is a block diagram showing the configuration of the system shown in FIG. 1.

As shown in FIG. 3, the rotation angles θsw1, θsw2 and θsw3 of the steering wheel 16 detected by the first to third rotation angle sensors 20*a*, 20*b* and 20*c* are inputted to the ECU 26. The steering angles θs1, θs2 and θs3 of the outboard motor 10 detected by the first to third steering angle sensors 46*a*, 46*b* and 46*c* and the engine speed NE detected by the engine speed sensor 48 are also inputted to the ECU 26.

Based on the inputted outputs θsw1, θsw2 and θsw3 of the first to third rotation angle sensors 20*a*, 20*b* and 20*c* and outputs θs1, θs2 and θs3 of the first to third steering angle sensors 46*a*, 46*b* and 46*c*, the ECU 26 determines or detects whether any of the rotation angle sensors and steering angle sensors has failed.

The ECU 26 determines or regulates a drive current Cd to be supplied to the steering motor 34 based on the inputted outputs of the sensors 20*a*, 20*b*, 20*c*, 46*a*, 46*b* and 46*c* and controls the operation of the steering motor 34 to regulate the steering angle of the outboard motor 10.

Figure 4:
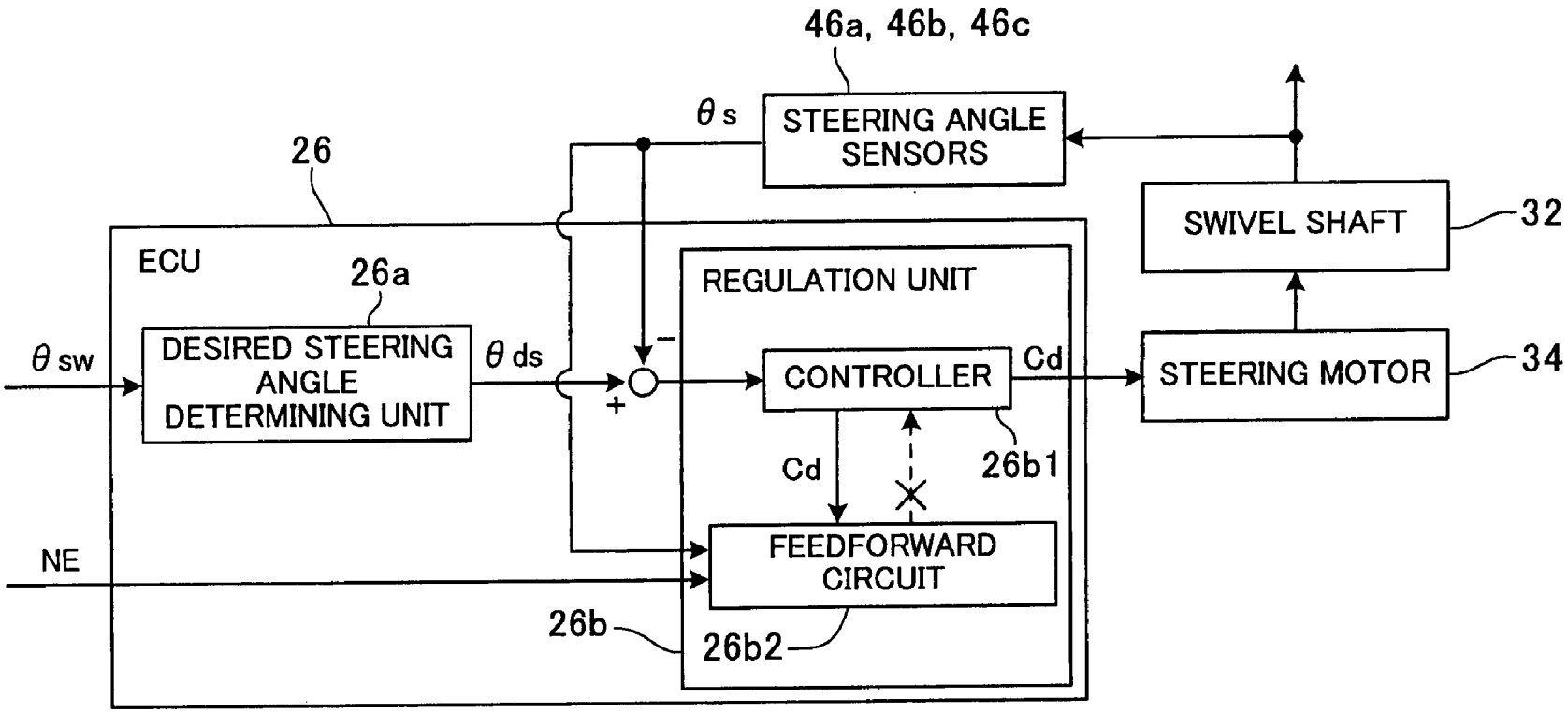
FIG. 4 is a block diagram showing the operation of the system, more specifically the processing performed for controlling the operation of an electric steering motor shown in FIG. 1.

FIG. 4 is a block diagram showing the operation of the system, more specifically the processing performed for controlling the operation of the steering motor 34. A general explanation of the control of the operation of the steering motor 34 is explained with reference to FIG. 4 in the following. The processing represented by the block diagram of FIG. 4 is carried out when at least one of the first to third steering angle sensors 46*a*, 46*b* and 46*c* operates normally. The troubleshooting processing is explained later.

As shown in FIG. 4, the ECU 26 is equipped with a desired steering angle determining unit 26*a* and a regulation unit 26*b*. The regulation unit 26*b* is equipped with a controller 26*b*1 and feedforward circuit 26*b*2.

The desired steering angle determining unit 26*a* inputs the rotation angle θsw of the steering wheel 16 (more exactly, one of the rotation angles θsw1, θsw2 and θsw3 detected by the first to third rotation angle sensors 20*a*, 20*b* and 20*c*). The desired steering angle determining unit 26*a* determines a desired steering angle θds based on the inputted rotation angle θsw.

The controller 26*b*1 of the regulation unit 26*b* inputs the error or difference between the desired steering angle θds determined in the desired steering angle determining unit 26*a* and the detected steering angle θs of the outboard motor 10 (the feedback signal; more exactly, one of the steering angles θs1, θs2 and θs3 detected by the first to third steering angle sensors 46*a*, 46*b* and 46*c*).

The controller 26*b*1 determines the drive current (current command value) Cd to be supplied to the steering motor 34 based on the inputted error. Specifically, it determines the drive current Cd so that the steering motor 34 is operated in the direction for eliminating the error between the desired steering angle θds and the detected steering angle θs. The controller 26*b*1 controls the operation of the steering motor 34 by supplying the determined drive current Cd to the steering motor 34, thereby rotating the swivel shaft 32 to control the steering angle θs of the outboard motor 10 to the desired steering angle θds.

So as long as at least one of the first to third steering angle sensors 46*a*, 46*b* and 46*c* operates normally, the operation of the steering motor 34 can be controlled by determining the drive current Cd based on the detected rotation angle θsw of the steering wheel 16 and the steering angle θs of the outboard motor 10, thereby controlling the steering angle θs of the outboard motor 10 to the desired steering angle θds (feedback control).

The engine speed NE detected by the engine speed sensor 48, the drive current Cd of the steering motor 34 determined by the controller 26*b*1 and the steering angle θs detected by one of the first to third steering angle sensors 46*a*, 46*b* and 46*c* are inputted to the feedforward circuit 26*b*2 of the regulation unit 26*b*. The feedforward circuit 26*b*2 stores the inputted drive current Cd as characteristics with respect to the steering angle θs and engine speed NE.

Figure 5:
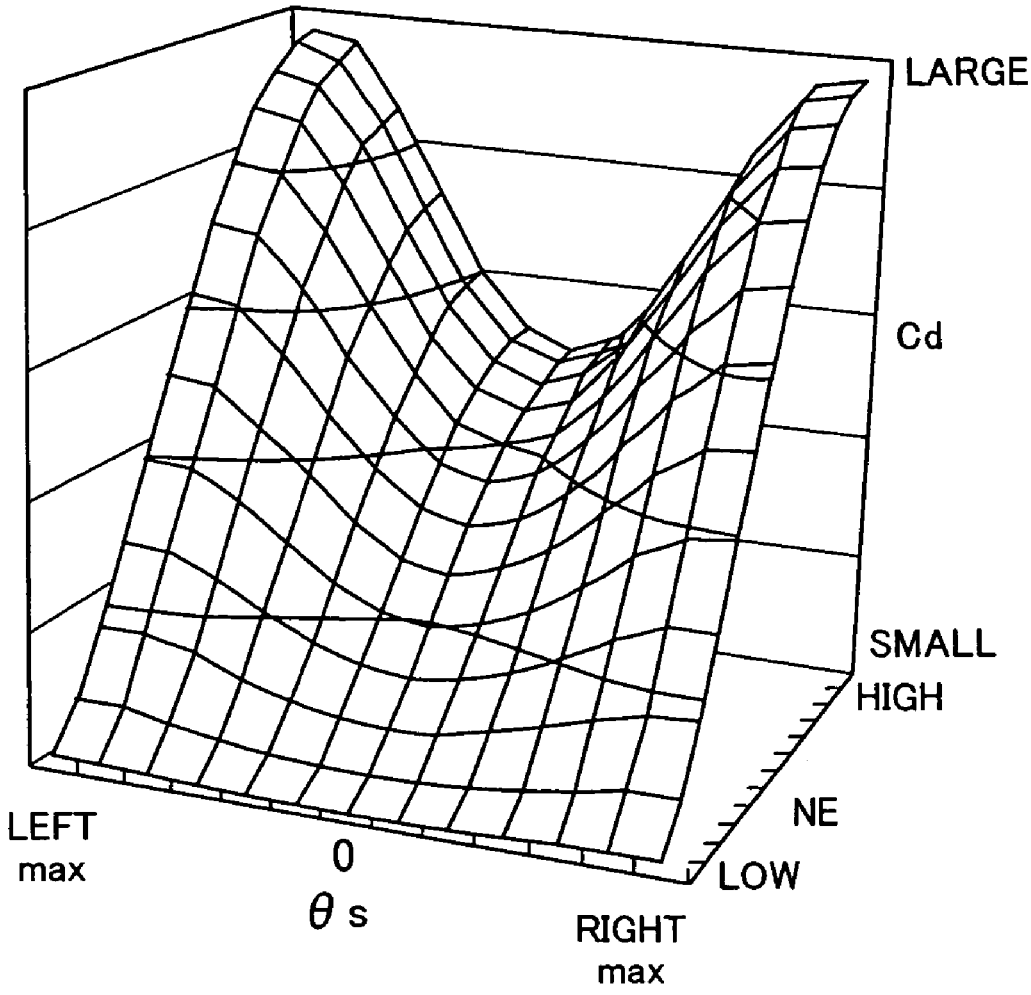
FIG. 5 is a graph showing characteristics of drive current with respect to a steering angle and engine speed, which are stored in an ECU shown in FIG. 4.

FIG. 5 is a graph showing an example of the characteristics of the drive current Cd with respect to the steering angle θs and engine speed NE.

As shown in FIG. 5, the drive current Cd is determined so that it increases with increasing engine speed NE and increasing steering angle θs. This is because when the engine speed NE rises (i.e., the boat speed rises) and/or the steering angle θs increases, the resulting rise in water flow resistance causes the drive current Cd of the steering motor 34 required for steering the outboard motor 10 to increase.

It should be noted that the graph of FIG. 5 represents the magnitude of the drive current Cd required to change the steering angle θs a unit angle per unit time as a function of the steering angle θs and engine speed NE. Insofar as at least one of the first to third steering angle sensors 46*a*, 46*b* and 46*c* operates normally, the characteristics shown in the graph of FIG. 5 is updated based on the values newly inputted by the feedforward circuit 26*b*2.

Figure 6:
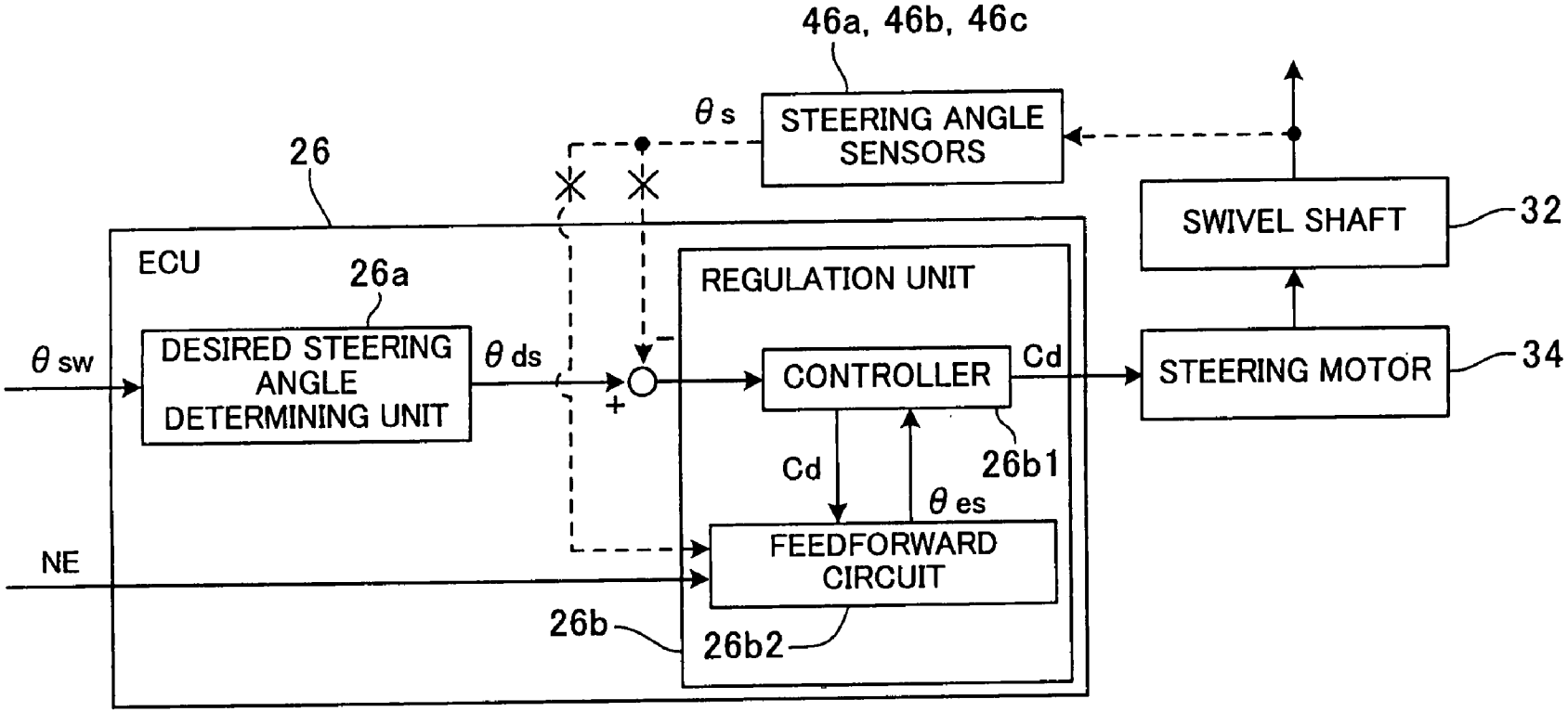
FIG. 6 is a block diagram, similar to FIG. 4, but showing the processing performed for controlling the operation of the electric steering motor when all of steering angle sensors shown in FIG. 1 have been detected as failed.

FIG. 6 is a block diagram, similar to FIG. 4, but showing the processing performed for controlling the operation of the electric steering motor 34 when all of the first to third steering angle sensors 46*a*, 46*b* and 46*c* have been detected as failed.

When it is detected that all of the first to third steering angle sensors 46*a*, 46*b* and 46*c* have failed, as shown in FIG. 6, the detection values of the first to third steering angle sensors 46*a*, 46*b* and 46*c* are not used to control the operation of the steering motor 34.

Specifically, the desired steering angle θds determined in the desired steering angle determining unit 26*a* is outputted to the controller 26*b*1 immediately (in other words, without being subtracted by the detected steering angle θs). Further, an estimated value of the steering angle θs (hereinafter referred to as "estimated steering angle") θes is inputted to the controller 26*b*1 from the feedforward circuit 26*b*2. As mentioned above, the feedforward circuit 26*b*2 stores the drive current Cd as the characteristics with respect to the steering angle θs and engine speed NE. As a result, the current steering angle θs can be estimated from the magnitude of the drive current Cd supplied to the steering motor 34 and the current engine speed NE.

The controller 26*b*1 determines the drive current Cd based on the inputted desired steering angle θds and estimated steering angle θes, and then controls the operation of the steering motor 34 by supplying the determined drive current Cd thereto. Thus when it is detected that all of the first to third steering angle sensors 46*a*, 46*b* and 46*c* have failed, the drive current Cd is determined based on the detected rotation angle θsw of the steering wheel 16 and the estimated steering angle θes of the outboard motor 10, thereby controlling the operation of the steering motor 34 so as to control the steering angle θs of the outboard motor 10 to the desired steering angle θds.

Figure 7:
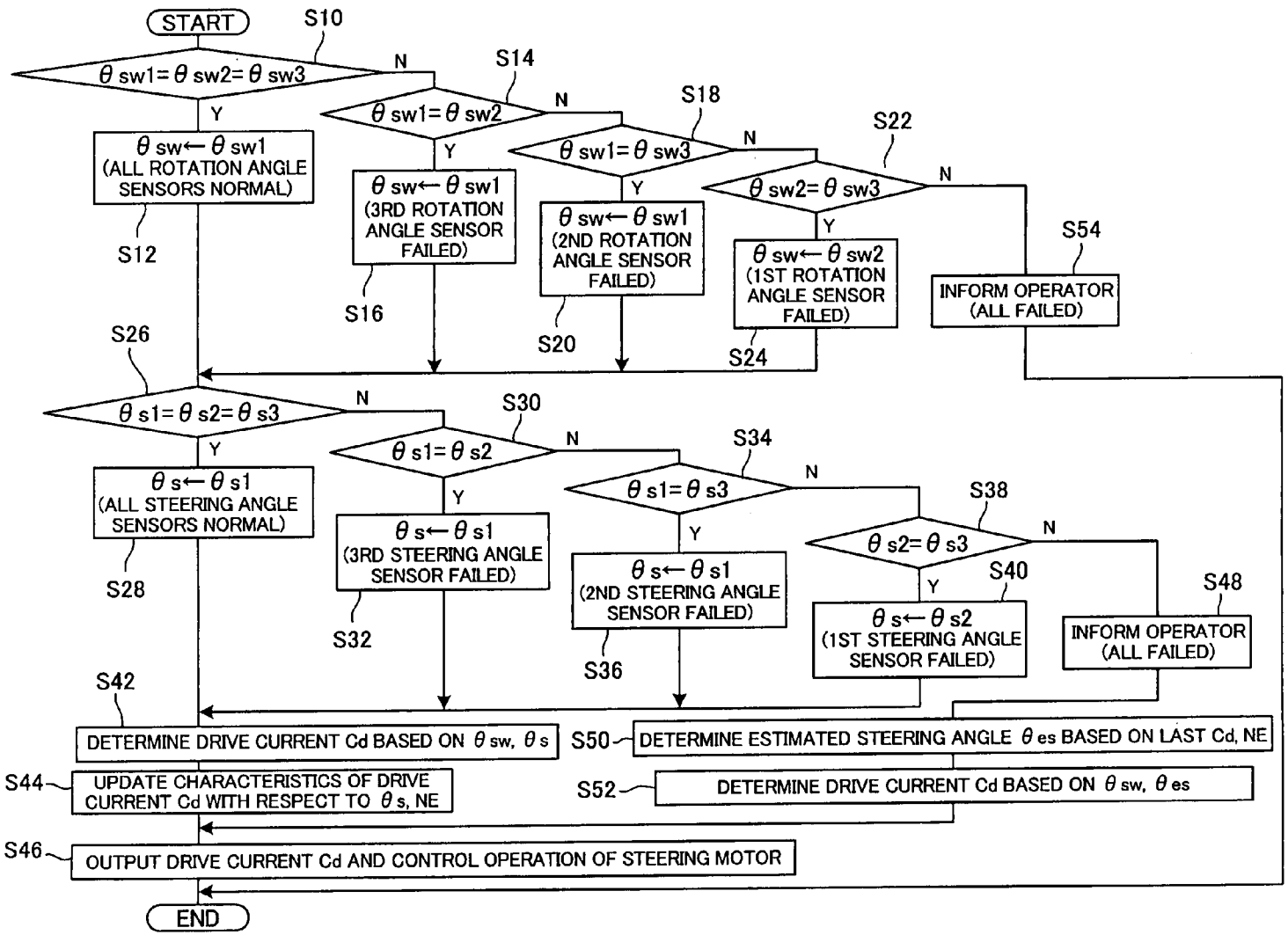
FIG. 7 is a flow chart showing the operation of the system, more specifically processing performed for controlling the operation of the electric steering motor shown in FIG. 1.

FIG. 7 is a flowchart showing the operation of the system, more specifically the flow of the processing for controlling the operation of the steering motor 34, detecting failure of the first to third steering angle sensors 46*a*, 46*b* and 46*c*, and conducting related operations. The illustrated program is executed at predetermined intervals in the ECU 26.

The processing of the flowchart of FIG. 7 will now be explained. First, in S10, it is determined whether the values of the rotation angles θsw1, θsw2 and θsw3 of the steering wheel 16 detected by the first to third rotation angle sensors 20*a*, 20*b* and 20*c* are all equal (or nearly equal).

When the result in S10 is YES, the program goes to S12, in which all of the first to third rotation angle sensors 20*a*, 20*b* and 20*c* are determined to operate normally, and the output θsw1 of the first rotation angle sensor 20*a* is determined as the current or present value of the rotation angle θsw of the steering wheel 16. The purpose of this processing is to select from among the outputs of the plurality of (three) rotation angle sensors the output of a normally operating sensor, thereby ensuring that the selected output accurately represents the rotation angle of the steering wheel 16. From this it follows that the output determined as the current value of the rotation angle θsw in S12 need not necessarily be the output θsw1 of the first rotation angle sensor 20*a* but can instead be the output θsw2 of the second rotation angle sensor 20*b* or the output θsw3 of the third rotation angle sensor 20*c*.

When the result in S10 is NO, the program goes to S14, in which it is determined whether the values of the output θsw1 of the first rotation angle sensor 20*a* and the output θsw2 of the second rotation angle sensor 20*b* are equal (or nearly equal). When the result in S14 is YES, i.e., when it can be concluded that the output θsw3 of the third rotation angle sensor 20*c* differs from the other two outputs θsw1 and θsw2, the program goes to S16, in which the third rotation angle sensor 20*c* is determined to have failed and the output θsw1 of the first rotation angle sensor 20*a* (optionally the output θsw2 of the second rotation angle sensor 20*b*) is determined as the rotation angle θsw of the steering wheel 16.

The third rotation angle sensor 20*c* is determined to have failed in S16 based on the reasoning that when, among the outputs of the three rotation angle sensors 20*a*, 20*b* and 20*c*, only the output of the third rotation angle sensor 20*c* is of a different value, the probability of the third rotation angle sensor 20*c* having failed is high.

When the result in S14 is NO, the program goes to S18, in which it is determined whether the values of the output θsw1 of the first rotation angle sensor 20*a* and the output θsw3 of the third rotation angle sensor 20*c* are equal (or nearly equal). When the result in S18 is YES, i.e., when it can be concluded that the output θsw2 of the second rotation angle sensor 20*b* differs from the other two outputs θsw1 and θsw3, the program goes to S20, in which the second rotation angle sensor 20*b* is determined to have failed and the output θsw1 of the first rotation angle sensor 20*a* (optionally the output θsw3 of the third rotation angle sensor 20*c*) is determined as the rotation angle θsw of the steering wheel 16. The second rotation angle sensor 20*b* is determined to be faulty in S20 based on reasoning that similar to that in S16.

When the result in S18 is NO, the program goes to S22, in which it is determined whether the values of the output θsw2 of the second rotation angle sensor 20*b* and the output θsw3 of the third rotation angle sensor 20*c* are equal (or nearly equal). When the result in S22 is YES, i.e., when it can be concluded that the output θsw1 of the first rotation angle sensor 20*a* differs from the other two outputs 74 sw2 and θsw3, the program goes to S24, in which, based on reasoning similar to that in S16 and S20, the first rotation angle sensor 20*a* is determined to have failed and the output θsw2 of the second rotation angle sensor 20*b* (optionally the output θsw3 of the third rotation angle sensor 20*c*) is determined as the rotation angle θsw of the steering wheel 16.

Once the rotation angle θsw of the steering wheel 16 has been determined, the program goes to S26, in which it is determined whether the values of the steering angles θs1, θs2 and θs3 of the outboard motor 10 detected by the first to third steering angle sensors 46*a*, 46*b* and 46*c* are all equal (or nearly equal).

When the result in S26 is YES, the program goes to S28, in which all of the first to third steering angle sensors 46*a*, 46*b* and 46*c* are determined to operate normally, and the output θs1 of the first steering angle sensor 46*a* is determined as the current or present value of the steering angle θs of the outboard motor 10. The reasoning here is similar to that in S12 explained earlier. That is, the purpose of this processing is to select from among the outputs of the plurality (three) of steering angle sensors the output of a normally operating sensor, thereby ensuring that the selected output accurately represents the steering angle of the outboard motor 10. Similarly, the output determined as the current value of the steering angle θs in S28 need not necessarily be the output θs1 of the first steering angle sensor 46*a* but can instead be the output θs2 of the second steering angle sensor 46*b* or the output θs3 of the third steering angle sensor 46*c*.

When the result in S26 is NO, the program goes to S30, in which it is determined whether the values of the output θs1 of the first steering angle sensor 46*a* and the output θs2 of the second steering angle sensor 46*b* are equal (or nearly equal). When the result in S30 is YES, i.e., when it can be concluded that the output θs3 of the third steering angle sensor 46*c* differs from the other two outputs θs1 and θs2, the program goes to S32, in which, based on reasoning similar to that in S16, for example, the third steering angle sensor 46*c* is determined to have failed and the output θs1 of the first steering angle sensor 46*a* (or the output θs2 of the second steering angle sensor 46*b*) is determined as the steering angle θs of the outboard motor 10.

When the result in S30 is NO, the program goes to S34, in which it is determined whether the values of the output θs1 of the first steering angle sensor 46*a* and the output θs3 of the third steering angle sensor 46*c* are equal (or nearly equal). When the result in S34 is YES, i.e., when it can be concluded that the output θs2 of the second steering angle sensor 46*b* differs from the other two outputs θs1 and θs3, the program goes to S36, in which the second steering angle sensor 46*b* is determined to have failed and the output θs1 of the first steering angle sensor 46*a* (or the output θs3 of the third steering angle sensor 46*c*) is determined as the steering angle θs of the outboard motor 10.

When the result in S34 is NO, the program goes to S38, in which it is determined whether the values of the output θs2 of the second steering angle sensor 46*b* and the output θs3 of the third steering angle sensor 46*c* are equal (or nearly equal). When the result in S38 is YES, i.e., when it can be concluded that the output θs1 of the first steering angle sensor 46*a* differs from the other two outputs θs2 and θs3, the program goes to S40, in which the first steering angle sensor 46*a* is determined to have failed and the output θs2 of the second steering angle sensor 46*b* (or the output θs3 of the third steering angle sensor 46*c*) is determined as the steering angle θs of the outboard motor 10.

Once the steering angle θs of the outboard motor 10 has been determined, the program goes to S42, in which the drive current Cd to be supplied to the steering motor 34 is determined based on the determined rotation angle θsw of the steering wheel 16 detected by one of the three rotation angle sensors and the determined steering angle θs of the outboard motor 10 detected by one of the three steering angle sensors. Specifically, as has been explained with reference to the block diagram of FIG. 4, the desired steering angle θds is determined based on the determined rotation angle θsw of the steering wheel 16 and the drive current Cd is determined so that the steering motor 34 is operated in the direction for eliminating or decreasing the error between the set desired steering angle θds and the actual steering angle θs.

The program then goes to S44, in which the characteristics of the drive current Cd with respect to the steering angle θs and engine speed NE is updated based on the present and past values of the steering angle θs, engine speed NE and drive current Cd. Specifically, the magnitude of the drive current Cd required to change the steering angle θs a unit angle per unit time is calculated based on current and past values of the steering angle θs and drive current Cd and the calculated values are stored as representing the characteristics of the drive current Cd with respect to the steering angle θs and engine speed NE at that time.

Next, in S46, the determined drive current Cd is outputted to control the operation of the steering motor 34 so as to converge the steering angle θs to the desired steering angle θds.

When the result in S38 is NO, i.e., when the outputs of the first to third steering angle sensors 46*a*, 46*b* and 46 are all different with each other, so that it becomes impossible to determine which, if any, of the sensors operates normally, the program goes to S48, in which it is determined that all of the sensors have failed and the operator is informed, visually or audibly, for instance, of the fact that the steering angle sensors have been detected as failed. At the same time, the operation of the actuator connected to the throttle valve of the engine 24 is controlled to reduce the throttle opening so as to lower the engine speed NE and stop the boat 12.

Next, in S50, the estimated steering angle θes, namely the estimated value of the steering angle θs is determined based on the drive current Cd and engine speed NE.

The processing for determining the estimated steering angle θes will be explained.

The drive current Cd to be supplied to the steering motor 34 and the engine speed NE at the time the drive current Cd is supplied (in other words, the value of the drive current Cd in the preceding cycle and the value of the engine speed NE in the preceding cycle) are used as address data for retrieving the change Δθs in the steering angle θs per unit time (per program execution cycle) from the characteristics shown in FIG. 5. The value obtained by adding the change Δθs to the most recent or latest θs (i.e., the value in the preceding cycle) detected by the steering angle sensor (when operating normally) is determined as the estimated steering angle θes (estimated value of the current steering angle θs).

When the value of the estimated steering angle θes in the preceding cycle is available (i.e., when the change Δθs is not being ascertained for the first time), the value of the estimated steering angle θes in the current cycle can be calculated by adding the change Δθs to the estimated steering angle θes in the preceding cycle.

Next, in S52, the drive current Cd is determined based on the rotation angle θsw of the steering wheel 16 detected by one of the three rotation angle sensors and the estimated steering angle θes determined in the foregoing manner.

Specifically, the desired steering angle θds is determined based on the rotation angle θsw and the drive current Cd is determined so that the steering motor 34 is operated in the direction for eliminating the error between the desired steering angle θds and the estimated steering angle θes. The program then goes to S46, in which the determined drive current Cd is outputted to control the operation of the steering motor 34 so as to make the steering angle θs of the outboard motor 10 equal to the desired steering angle θds.

When the result in S22 is NO, i.e., when the outputs of the first to third rotation angle sensors 20*a*, 20*b* and 20*c* are all different from each other and it becomes impossible to determine which, if any, of the sensors is operating normally, the program goes to S54, in which it is determined that all of the sensors have failed and the operator is informed, visually or audibly, for instance, that the rotation angle sensors have failed. In addition, the operation of the steering motor 34 cannot be controlled because the desired steering angle θds is not able to be determined when it is not possible to detect the rotation angle of the steering wheel 16 accurately. The steps S26 to S52 are therefore all skipped. At the same time, the operation of the actuator connected to the throttle valve of the engine 24 is controlled to reduce the throttle opening so as to lower the engine speed NE and stop the boat 12.

As explained in the foregoing, in the outboard motor steering control system according to this invention, a plurality of rotation angle sensors 20*a*, 20*b* and 20*c* are provided for detecting the rotation angle θsw of the steering wheel 16 and a plurality of steering angle sensors 46*a*, 46*b* and 46*c* are installed for detecting the steering angle θs of the outboard motor 10, and the drive current Cd is determined based on the outputs of normally operating sensors thereamong, thereby controlling the operation of the steering motor 34. This configuration enhances the reliability of the outboard motor steering system.

Moreover, the outboard motor steering system is configured to respond to detection that all of the multiple steering angle sensors 46*a*, 46*b* and 46*c* have failed by determining the estimated steering angle θes, namely the estimated value of the steering angle θs, based on the drive current Cd to be supplied to the steering motor 34 and the engine speed NE at the time the drive current Cd is supplied and determining or regulating the drive current Cd based on the estimated steering angle θes and the rotation angle θsw of the steering wheel 16. Owing to this configuration, steering of the outboard motor 10 can be continued even when all of the steering angle sensors 46*a*, 46*b* and 46*c* have failed. This configuration further enhances the reliability of the outboard motor steering system.

Further, the outboard motor steering system is configured to store the drive current Cd as the characteristics with respect to the steering angle θs and engine speed NE and respond to detection that not all of the steering angle sensors 46*a*, 46*b* and 46*c* have failed (at least one operates normally) by updating the characteristics based on the drive current Cd to be supplied to the steering motor 34 and the detected engine speed NE and steering angle θs and respond to detection that all of the multiple steering angle sensors 46*a*, 46*b* and 46*c* are faulty by using the drive current Cd supplied to the steering motor 34 and the engine speed NE at that time to determine the estimated steering angle θes from the characteristics. The steering 43, angle θs can therefore be accurately estimated unaffected by aging of, or characteristics peculiar to, the outboard motor concerned. This configuration therefore further enhances the reliability of the outboard motor steering system.

The present exemplary embodiment is thus configured to have a system for controlling steering of an outboard motor (10) adapted to be mounted on a stern of a boat (12) and having an internal combustion engine (24) powering a propeller (30), comprising: an actuator (electric steering motor 34) steering the outboard motor relative to the boat; a rotation angle sensor (20) detecting a rotation angle θsw of a steering wheel (16) installed at the boat; a plurality of steering angle sensors (46) each detecting a steering angle θs of the outboard motor relative to the boat; a controller (ECU 26; S42) determining a drive current Cd to be supplied to the actuator based on the detected rotation angle and at least one of the detected steering angles and supplying the determined drive current to the actuator to control operation of the actuator; an engine speed sensor (48) detecting a speed of the engine NE; a steering angle estimator (ECU 26; S50) estimating the steering angle θes of the outboard motor relative to the boat, based on the determined drive current and the detected engine speed; and a steering angle sensor failure detector (ECU 26; S26 to S40, S48) detecting failure of the steering angle sensors; wherein the controller determines the drive current based on the detected rotation angle θsw and the estimated steering angle θes, when all of the steering angle sensors are detected to have failed (S52).

In the system, the steering angle estimator includes: a drive current characteristics determiner (ECU 26; S44) determining characteristics of the drive current Cd with respect to the detected steering angle θs and the detected engine speed NE when not all of the steering angle sensors are detected to have failed; and estimates the steering angle θes based on the drive current Cd supplied to the actuator and the detected engine speed NE in accordance with the characteristics.

In the system, at least three of the steering angle sensors (46) are used (46*a*, 46*b*, 46*c*), and the steering angle sensor failure detector detects that one of the steering angle sensors has failed when outputs of other two steering angle sensors are equal (S26 to S40), but different than the output of the one sensor.

The system further includes: a plurality of the rotation angle sensors (20*a*, 20*b*, 20*c*) each detecting the rotation angle of the steering wheel installed at the boat; and the controller determines the drive current Cd based on at least one of the detected rotation angles and at least one of the detected steering angles (S42).

The system further includes: a rotation angle sensor failure detector (ECU 26, S10 to S24, S54) detecting failure of the rotation angle sensors.

In the system, at least three of the rotation angle sensors (20) are used (20*a*, 20*b*, 20*c*), and the rotation angle sensor failure detector detects one of the rotation angle sensors has failed when outputs of other two rotation angle sensors are equal (S10 to S24)), but different than the output of the one sensor.

Although the outboard motor steering system described in the foregoing is explained as having three each of the rotation angle sensors for detecting the rotation angle θsw of the steering wheel 16 and the steering angle sensors for detecting the steering angle θs of the outboard motor 10, the number of these sensors is not limited to three each. The number of rotation angle sensor may be one and that of the steering angle sensor may be four or more.

Although the steering actuator is exemplified as an electric motor in the foregoing, it can instead be a hydraulic actuator or any of various other kinds of actuators. When a hydraulic actuator is used, it suffices to determine the drive current to be supplied to operate the hydraulic pump based on the rotation angle θsw and the steering angle θs (or the estimated steering angle θes).

While the invention has thus been shown and described with reference to specific exemplary embodiments, it should be noted that the invention is in no way limited to the details of the described arrangements; changes and modifications may be made without departing from the scope of the appended claims.

What is claimed is:

1. A system for controlling steering of an outboard motor adapted to be mounted on a stern of a boat and having an internal combustion engine powering a propeller, comprising:

an actuator which steers the outboard motor relative to the boat;

a rotation angle sensor which detects a rotation angle of a steering wheel installed at the boat;

a plurality of steering angle sensors which each detect a steering angle of the outboard motor relative to the boat;

a controller which determines a drive current to be supplied to the actuator based on the detected rotation angle and at least one of the detected steering angles and supplies the determined drive current to the actuator to control operation of the actuator;

an engine speed sensor which detects a speed of the engine;

a steering angle estimator which estimates the steering angle of the outboard motor relative to the boat, based on the determined drive current and the detected engine speed; and a steering angle sensor failure detector which detects failure of the steering angle sensors;

wherein the controller determines the drive current based on the detected rotation angle and the estimated steering angle, when all of the steering angle sensors are detected to have failed.

2. The system according to claim 1, wherein the steering angle estimator includes:

a drive current characteristics determiner which determines characteristics of the drive current with respect to the detected steering angle and the detected engine speed when not all of the steering angle sensors are detected to have failed;

and estimates the steering angle based on the drive current supplied to the actuator and the detected engine speed in accordance with the characteristics.

3. The system according to claim 1, comprising at least three of the steering angle sensors, and the steering angle sensor failure detector detects that one of the steering angle sensors has failed when outputs of two other of the steering angle sensors are equal.

4. The system according to claim 1, further including:

a plurality of the rotation angle sensors which each detect the rotation angle of the steering wheel installed at the boat;

and the controller determines the drive current based on at least one of the detected rotation angles and at least one of the detected steering angles.

5. The system according to claim 4, further including:

a rotation angle sensor failure detector which detects failure of the rotation angle sensors.

6. The system according to claim 5, comprising at least three of the rotation angle sensors, and the rotation angle sensor failure detector detects that one of the rotation angle sensors has failed when outputs of two other of the rotation angle sensors are equal.

7. A method of controlling steering of an outboard motor mounted on a stern of a boat and having an internal combustion engine powering a propeller, involving an actuator steering the outboard motor relative to the boat, a rotation angle sensor detecting a rotation angle of a steering wheel installed at the boat, and a plurality of steering angle sensors each detecting a steering angle of the outboard motor relative to the boat, comprising the steps of:

determining a drive current to be supplied to the actuator based on the detected rotation angle and at least one of the detected steering angles and supplying the determined drive current to the actuator to control operation of the actuator;

detecting a speed of the engine;

estimating the steering angle of the outboard motor relative to the boat, based on the determined drive current and the detected engine speed; and detecting failure of the steering angle sensors;

wherein the step of drive current determining involves determining the drive current based on the detected rotation angle and the estimated steering angle, when all of the steering angle sensors are detected to have failed.

8. The method according to claim 7, wherein the step of steering angle estimating involves:

determining characteristics of the drive current with respect to the detected steering angle and the detected engine speed when not all of the steering angle sensors are detected to have failed;

and estimating the steering angle based on the drive current supplied to the actuator and the detected engine speed in accordance with the characteristics.

9. The method according to claim 7, involving at least three of the steering angle sensors, and the step of steering angle sensor failure detecting involves detecting that one of the steering angle sensors has failed when outputs of two other of the steering angle sensors are equal, but different than an output of the one steering angle sensor.

10. The method according to claim 7, further including:

a plurality of the rotation angle sensors each detecting the rotation angle of the steering wheel installed at the boat;

and the step of drive current determining involves determining the drive current based on at least one of the detected rotation angles and at least one of the detected steering angles.

11. The method according to claim 10, further including the step of:

detecting failure of the rotation angle sensors.

12. The method according to claim 11, involving at least three of the rotation angle sensors, and the step of rotation angle sensor failure detecting involves detecting that one of the rotation angle sensors has failed when outputs of two other of the rotation angle sensors are equal, but different than an output of the one rotation angle sensor.

* * * * *